US005409128A

United States Patent [19]

Mitchell

[11] Patent Number: 5,409,128

[45] Date of Patent: Apr. 25, 1995

[54] STACKABLE CONTAINER

[75] Inventor: James M. Mitchell, Huntington Beach, Calif.

[73] Assignee: Safeco Plastics, Inc., Huntington Beach, Calif.

[21] Appl. No.: 223,774

[22] Filed: Apr. 6, 1994

[51] Int. Cl.[6] ..... B65D 21/02

[52] U.S. Cl. ..... 220/23.4; 220/23.6; 206/508; 206/509

[58] Field of Search ..... 206/509, 507, 508; 220/23.6, 23.4

[56] References Cited

U.S. PATENT DOCUMENTS

| | | | |
|---|---|---|---|
| 4,624,383 | 11/1986 | Moore | 220/23.6 |
| 4,690,271 | 9/1987 | Zak | 206/1.7 |
| 5,150,804 | 9/1992 | Blanchet et al. | 206/509 |
| 5,154,295 | 10/1992 | Stoner | 206/509 |

*Primary Examiner*—Joseph Man-Fu Moy
*Attorney, Agent, or Firm*—Knobbe, Martens, Olson & Bear

[57] ABSTRACT

An improved stackable container adapted to positively lock with a second container. The container includes a base and a lid for covering a storage space within the base. The base includes a downwardly depending rim having an inner diameter sized to fit over an upwardly extending cylindrical step on the lid of a second container, the downwardly depending rim and upwardly extending step including locking structures for positively locking a base of one container to a lid of another container. The locking structure preferably includes a plurality of multiple thread segments evenly spaced around the lid and base. There are preferably twelve thread segments evenly spaced around the step of the lid and within the rim of the base, the vertical height of the step being relatively small and the angle of rotation to lock the lid and base together is correspondingly small. The present containers are specially suited for holding relatively heavy small objects therein and stacking a multiple of containers together without the stack separating when tilted or inverted.

23 Claims, 2 Drawing Sheets

Fig. 1
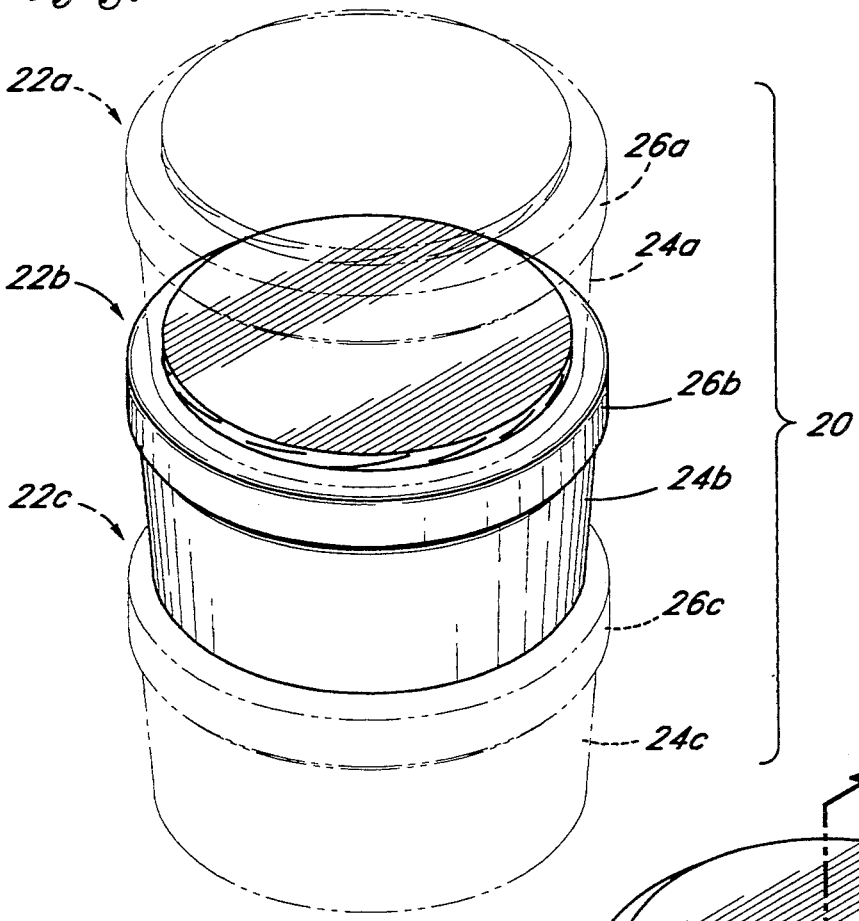
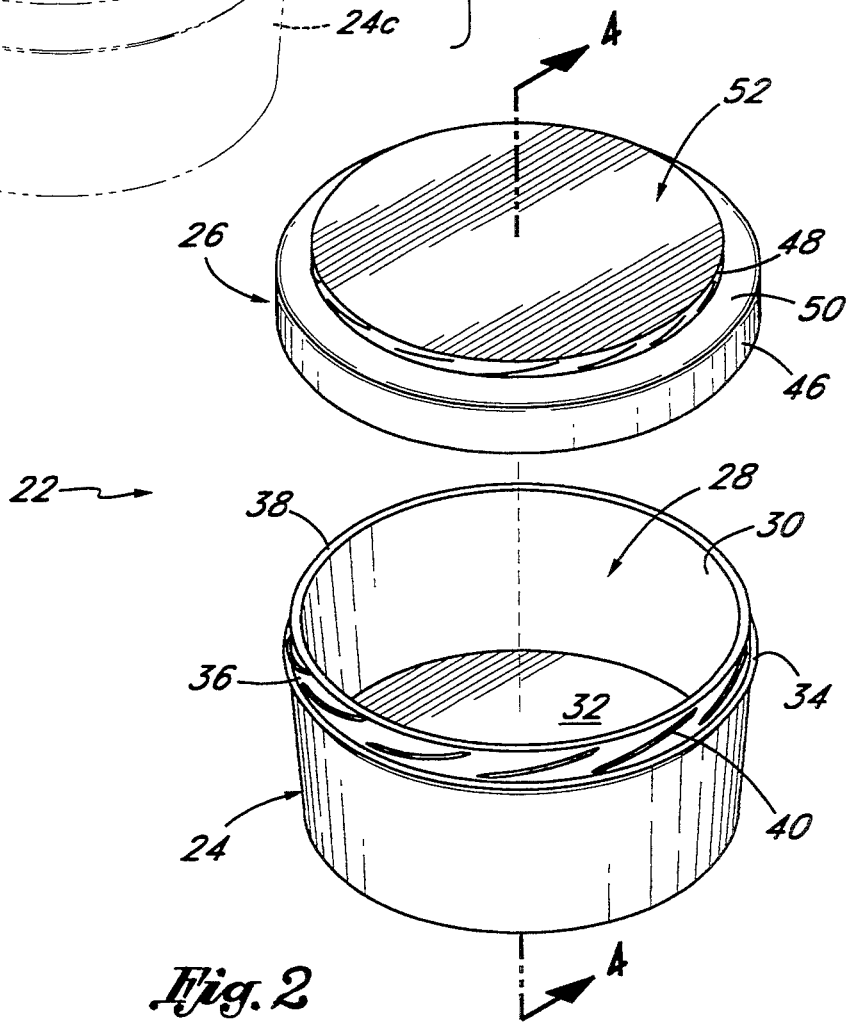
Fig. 2

STACKABLE CONTAINER

FIELD OF THE INVENTION

The present invention relates to stackable containers and, more particularly, to an improved stackable container capable of being positively locked to a second container.

BACKGROUND OF THE INVENTION

Numerous container designs in the past have incorporated structures for allowing the stacking of a plurality of containers in a column so as to increase packing efficiency or to eliminate relative transverse sliding therebetween. One example of stackable containers are common household plastic tubs having lids with recesses thereon, the base of the tub above fitting into the recess. The design of most stackable containers is simply to allow one container to be placed on top of another and an assumption is made that the stack will remain vertical and stable.

Some stackable containers are design to mate together to more securely maintain the vertical stack. One such design is shown in a small polyethylene stackable container with the trade name STACK PAK, manufactured by ULTRATEK of Salt Lake City, Utah. The STACK PACK container has a base with a lid attached to one side by a connecting flap. The top of the lid includes a circular step around the circumference of which is a small outwardly protruding ridge. The bottom of the base of the container includes a rim portion which has an inner diameter sized to fit over the ridge on the lid step. Three small inwardly projecting detents on the inner surface of the rim of the base are sized to provide an interference fit with the ridge of the lid step.

One STAK PAK container is thus placed on top of another with the rim of the base of the top container being pressed over the lid step of the lower container so that the detents are forced below the outwardly extending ridge, providing a an interference coupling between the two containers. Although the containers are nominally held together, the interference of the detents and ridge is insufficient to withstand even moderate separating forces. A column of STAK PAK containers holding articles within is especially susceptible to breaking apart when the column is tilted, as at most only one of the detents is holding the column together, due to the wide arcs between detents. Furthermore, the detents may wear away after repeated couplings and lose effectiveness.

The STACK PAK container, as well as a number of other non-stacking small plastic containers having lids, were initially designed for taking biological specimens from humans or animals. However, the size of these containers have made them popular with young children for holding disks used in playground games. Especially popular at this time, is a playground game generically termed a milk cap game which utilizes a plurality of thin paper disks with printing on one side and at least one thicker disk for slamming down on the paper disks. The heavier slamming disks may be made of paper, hard plastic, metal, or other suitable material. The actual game is essentially a vehicle for the distribution and trading of the game disks, which are marketed with a vast array of printed styles and designs. Thus, a player may possess numerous types of game disks, as well as a selection of the thicker slammer disks. The small containers mentioned above are thus ideal for segregating the various disks and the capacity for stacking a number of containers in a column is desirable. However, the STAK PAK container is ineffective for stacking more than a few full containers together, especially when used to store the heavier disks, as the stack becomes unstable due to the aforementioned structural reasons.

There is thus a need for a stackable container which avoids the deficiencies of the prior art.

SUMMARY OF THE INVENTION

The present invention provides a stackable container which can be stably stacked together with a number of other containers, all holding small heavy items therein. In particular, the present invention provides a stackable container having a base and a lid, the lid being adapted to be screwed onto or interlock with the base. The lid of the present container includes an upstanding step thereon sized to fit within a downwardly depending rim of a base of a second container. The step is provided with a plurality of short segments of multiple male threads, while the inner surface of the rim of the base is provided with a plurality of mating multiple female thread segments. Two containers can thus be fit together by screwing the base of one onto the lid of the other with the multiple thread segments engaging.

In one particular embodiment of the present invention, a stackable container system includes plurality of containers each having a base and a lid, the lid having a first plurality of multiple thread segments sized to mate with a second plurality of similarly angled multiple thread segments formed on a base of a second container. Desirably, there are six or more thread segments on both the lid and the base of the container and, more particularly, there are twelve of such thread segments. The container lid includes an upstanding cylindrical step whose outer circumference includes the first plurality of multiple thread segments extending outwardly. The base includes a downwardly depending rim having an inner diameter sized to fit over the step of the lid. The inner surface of the rim includes the second plurality of mating thread segments sized and shaped to mate with the thread segments on the lid. The system comprises the combination of two or more containers stacked together.

BRIEF DESCRIPTION OF THE DRAWINGS

FIG. 1 is a perspective view of a vertical stack of the present containers;

FIG. 2 is an exploded perspective view of a preferred embodiment of the stackable container of the present invention;

DESCRIPTION OF THE PREFERRED EMBODIMENT

Figure 3:
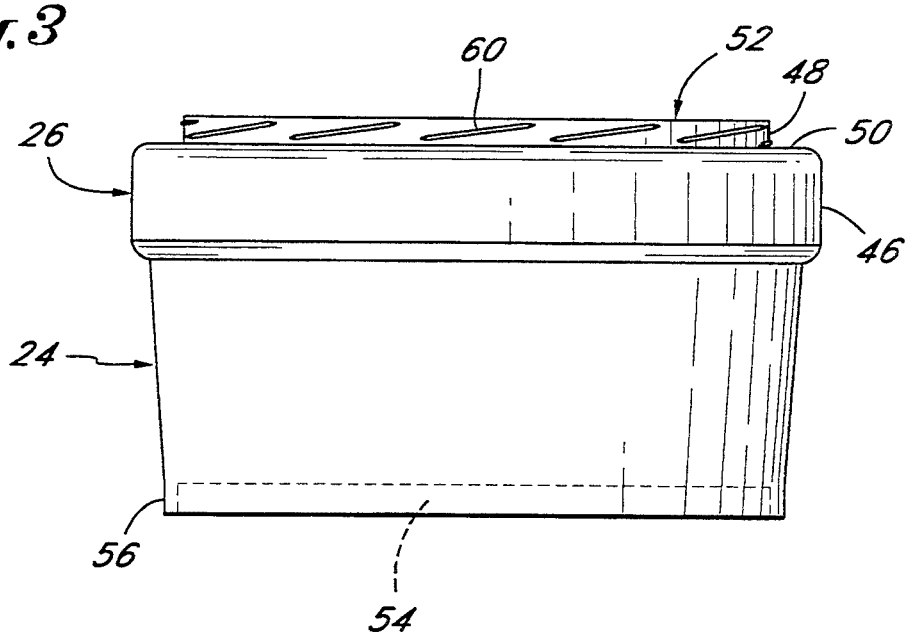
FIG. 3 is a side elevational view of the stackable container.

The present invention comprises a container adapted to be vertically stacked with a plurality of identical containers. FIG. 1 shows a stack 20 of three of the containers of the present invention, comprising an upper container 22*a*, a middle container 22*b*, and a lower container 22*c*, with the upper and lower containers shown in phantom. Each container 22 comprises a lower portion or base 24 and an upper portion or lid 26. The lid 26 of one container is configured to mate with the base 24 of a second container. Thus, as seen in the stack 20 of FIG. 1, the base 24*a* of the upper container 22*a* is adapted to mate with the lid 26*b* of the middle container 22*b*. Likewise, the base 24*b* of the middle container 22*b* is adapted to mate with the lid 26*c* of the lower container 22*c*. It will be understood that the following description of the preferred container 22 of the present invention applies to each of the containers shown in FIG. 1, and thus the letter designation will be dropped.

With reference now to FIG. 2, the base 24 is shown with the lid 26 removed. The base 24 includes a storage space 28 defined by an outer, generally cylindrical wall 30 and a floor 32 located slightly above the lower edge of the wall. The upper edge of the wall 30 includes a lid stopping rib 34 and a male thread section 36. The thread section 36 comprises a generally cylindrical, vertical surface extending between the lid stop 34 and an upper lip 38 and a plurality of outwardly projecting multiple threads 40 evenly spaced therearound. The male threads 40 mate with a plurality of multiple female threads 42 formed on an inner surface of the lid 26, best seen in FIG. 4. The lid 26 is screwed onto the base 24 until it contacts the lid stopping rib 34 to enclose the storage space 28. Multiple threads refers to thread configurations having two or more threads formed beside each other.

In one particular embodiment, the male and female threads 40, 42 have a height of approximately 0.017 inches and make a lead angle of approximately 9° with their rotational axes. Further, the threads 40, 42 are spiral threads and have a spiral length which dictates engagement for approximately 5° of rotation before the lid 26 is secured to the base 24.

Although the present embodiment contemplates a threaded connection between the lid 26 and base 24, other positive locking structures may be used. As will be appreciated from the discussion below, a stack 20 of containers of the present invention is held together more securely than stacks of prior art containers, the lid 26 and base 24 interface for each container must thus be positively locked together rather than simply snapped together so as not to detract from this secure combination.

Figure 4:
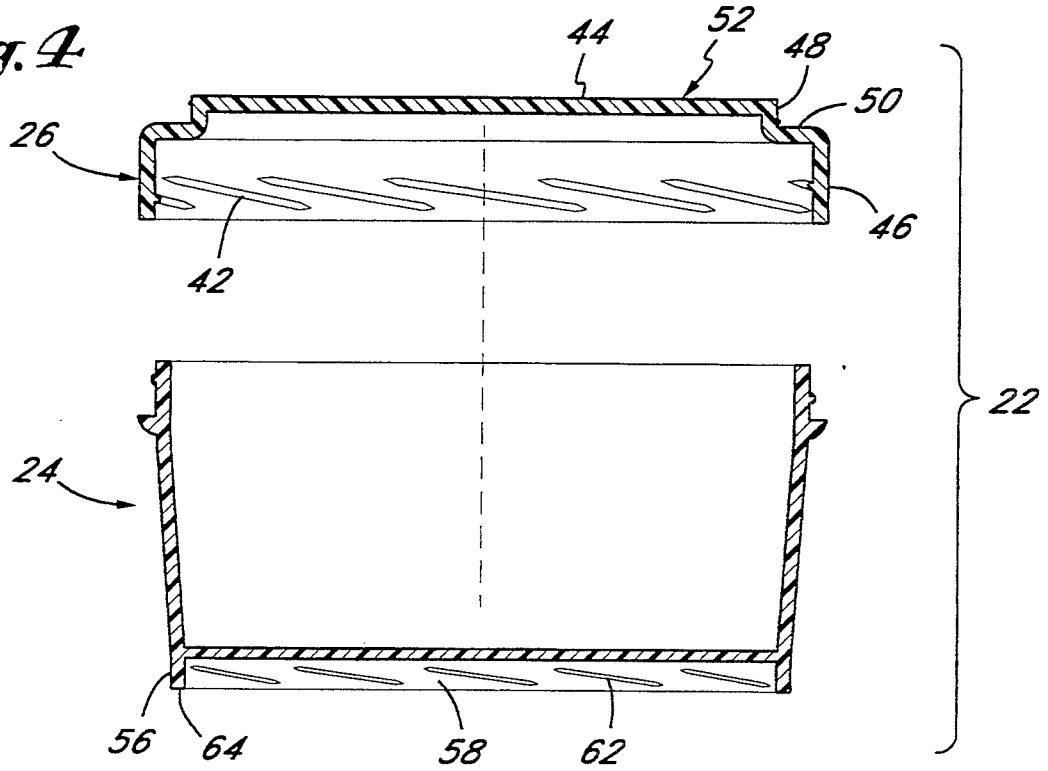
FIG. 4 is a sectional view of the stackable container taken along line 4—4 of FIG. 2.

With reference now to FIGS. 2–4, the lid 26 of the preferred container 20 comprises an upper horizontal top 44 joined to a vertical circular wall 46 by a vertical step portion 48 and a horizontal land 50. The step portion 48 and top 44 together form an upwardly projecting cylinder 52 smaller in diameter than the circular wall 46 and sized to fit within a cylindrical space 54 formed under the floor 32 and circumscribed by a lower circular rim 56 of the base 24. Adjacent containers 22 are thus stacked so that the cylinder 52 mates with the space 54 to align the containers and provide transverse stability therebetween.

The present container 22 additionally comprises a locking structure formed on the cylinder 52 adapted to mate with a complimentary locking structure formed on an inner wall 58 of the rim 56. In this respect, the present invention departs from designs of the prior art by providing a positive lock between containers so that a vertical stack of a plurality of containers holding items of weight therein will be more stable. More particularly, the cooperating locking structures of adjacent bases and lids will be strong enough to invert a stack of containers holding items therein without the containers separating. Additionally, the stack may be tilted at various angles without the containers breaking apart.

In a preferred embodiment of the locking structures, a plurality of multiple thread segments 60 project outwardly from the cylindrical land surface 48. A corresponding number and size of multiple thread segments 62 project inwardly from the inner surface 58 of the rim 56. These thread segments 60, 62 are designed to rapidly lock the base of one container to the lid of another container. By placing the base 24 of one container over a lid 26 of a second container and rotating the base relative to the lid, the threads 60, 62 interengage. The base 24 is advanced by screwing relative to the lid 26 until a terminal edge 64 of the rim 56 contacts the horizontal land 50 of the lid. Of course, a lid 26 can be removed and mated to the rim 56 of its base 24 to avoid losing the lid.

The components of the present container 22 are preferably infection molded polyethylene so that the threads 60, 62 and other contacting surfaces are subject to some frictional interaction upon tightening of a base 24 to a lid 26 to further enhance the positive lock therebetween. Although there will be some frictional interference between the thread segments 60, 62, the thread segments are constructed of a sufficient height and number to resist deformation and stripping from moderate torsional forces applied between the base and the lid. However, at the same time, there is an incentive to keep the vertical height of both the cylinder 52 and rim 56 to a minimum in order to reduce unused volume between containers 22. To this end, there is a balance between a desire for sufficiently strong threads segments 60, 62, the size of which is partly limited by the vertical surface area available, and the need for increased storage efficiency. In one embodiment, the thread segments 60, 62 are spiral threads with a thickness of approximately 0.005 inches.

In a preferred embodiment, there are between six and twelve thread segments 60, 62 in the respective lid and base sections. More preferably, there are twelve thread segments 60, 62 evenly spaced around the circumference of the lid 26 and within the rim 56, respectively. The provision of a large number of thread segments is preferred to distribute the torsional, tensile and bending stresses applied to a stack of connected containers 22. For example, if a stack of containers 22 is tilted, a plurality of thread segments on one side are subjected to tensile separating forces and act in harmony to resist such separation.

The multiple thread segments desirably make a lead angle of between 4° and 6° with the central axis of the lid 26 and base 24, respectively. More preferably, the thread segments 60, 62 make a lead angle of approximately 5° 15′ with the central axes which, for an average diameter of approximately 1.735 inches of the cylinder 52 and rim 56, dictates each thread, if extended, makes two complete revolutions per axial inch. The step portion 48 has an axial height of between 0.07 and 0.09 inches, and more particularly has an axial height of approximately 0.08 inches. Thus, the base 24 can be rotated no more than 30° degrees relative to the lid 26 to tighten it thereover. In practice, the thread segments 60, 62 are formed in only a portion of the step portion 48 and rim 56, and thus they engage for less than 10°. This "quick-release" is preferred for small containers and helps prevent excessive torquing of the base to the adjacent lid. More particularly, the short thread lengths and large number of multiple thread segments act to provide a more sudden and firm rotational stop, as opposed to greater thread lengths and a reduced number of threads which tend to impart more gradual or lower torsional resistance. In practice, one "feels" the rotational stop more suddenly and firmly and thus discontinues applying torque sooner.

The inner diameter of the storage space 28 is approximately 1.75 inches at a lower point, with the walls gradually tapering outward to approximately 1.87 inches at the upper rim for injection molding fabrication reasons. The base 24 is thus particularly suited for holding game pieces of a milk cap game. The storage space 28 preferably has a height of approximately 0.84 inches, but the base 24 may be manufactured taller to hold more disks. Further, it is contemplated that the present container 22 is suitable for storing any number of small items, such as medical samples, candy, small fasteners, etc. Indeed, the present container, although particularly suited for holding the aforementioned game pieces in large stacks, may be utilized in any number of applications.

The locking structures shown and described herein are not considered limiting to the present invention. In particular, the thread segments 60, 62 shown may be replaced by other thread arrangements having a larger pitch, or number, or by a detent lock configuration, which provides positive locking. One such detent lock is utilized in medical connectors, wherein an outwardly projecting nub on a male member extends into an L-shaped channel in a female member, the nub being forced into the channel against a bias and the two parts screwed relative to each other so that the nub is locked within a second portion of the channel until the engaging steps are reversed. Other such positive locking arrangements are also considered within the scope of the present invention, such as, for example, a reverse thread structure as shown, with the male threads on the base 24 and the female threads on the lid 26. In the reverse thread configuration, by way of example, the base 24 may include a downwardly depending step having male thread segments sized to engage within an upwardly projecting rim of the lid 26 having female thread segments.

Although this invention has been described in terms of certain preferred embodiments, other embodiments that are apparent to those of ordinary skill in the art are also within the range of this invention. Accordingly, the scope of the invention is intended to be defined only by reference to the following claims.

I claim:

1. A stackable container, comprising:

a base having an upstanding wall terminating at a lower portion in a rim, the upstanding wall defining an accessible storage space therein with a lower floor positioned above the lower edge of the rim, the rim including a first positive locking structure; and a lid having an outer circular wall greater in diameter than said rim for covering and attaching to an exterior surface on the upper portion of the upstanding wall of said base, said lid having a step extending upward, said step defining an upwardly projecting cylinder smaller in diameter than said outer circular wall and being adapted to engage with the rim of the base, said step additionally comprising a second positive locking structure sized and shaped to mate with the first positive locking structure formed in the rim of the base.

2. The container of claim 1, wherein the first locking structure is formed on the inner surface of the rim and comprises a plurality of multiple female thread segments extending inwardly, and said second locking structure comprises a plurality of multiple male thread segments formed on an outer surface of said step and sized and shaped to mate with the female thread segments formed in the base, the container being adapted to mate with a second container by screwing the base of the first container onto the lid of the second container or by screwing the base of the second container onto the lid of the first container.

3. The container of claim 2, wherein the female thread segments around the rim and male thread segments around the step are spirally configured and have a lead angle of approximately 5°.

4. The container of claim 2, wherein there are twelve female thread segments evenly spaced around the rim and twelve male thread segments evenly spaced around the step.

5. The container of claim 1, further including a second container wherein the first container is adapted to mate with said second container by locking the base of the first container onto the lid of the second container or by locking the base of the second container onto the lid of the first container.

6. A stackable container, comprising:

a base having an upstanding wall and a lower floor defining an accessible storage space therein, said base including a lower step below said floor having a first positive locking structure; and a lid having an outer circular wall greater in diameter than said rim for covering and attaching to an exterior surface on the upper portion of the upstanding wall of said base, said lid having a rim extending upward, said rim defining an upwardly projecting cylinder smaller in diameter than said outer circular wall and being adapted to engage with the step of the base, said rim additionally comprising a second positive locking structure sized and shaped to mate with the first positive locking structure formed in the step of the base.

7. A stackable container system, comprising:

two containers each having:

a lid having an outer circular wall and a first plurality of multiple thread segments formed on an upstanding cylindrical step sized smaller than said circular wall;

a base having an upper lid receiving portion and having a second plurality of multiple thread segments formed on a downwardly depending rim sized smaller than said circular wall, said second plurality of multiple thread segments sized and shaped to mate with said first plurality of multiple thread segments, so that either of said two bases can be stacked on either said two lids and attached thereto by way of said first and second thread segments.

8. The system of claim 7, wherein the first plurality of multiple thread segments extending outwardly from said cylindrical step and an inner surface of the rim includes the second plurality of mating thread segments sized and shaped to mate with the first plurality of thread segments on the step.

9. The system of claim 7, wherein there are six or more thread segments on both the lid and the base of each container.

10. The system of claim 9, wherein there are twelve thread segments on both the lid and the base of each container.

11. The system of claim 7, wherein the thread segments on each lid and base are spirally configured and have a lead angle of approximately 5°.

12. A stackable container, comprising:

a generally cylindrical base having an upstanding circular wall with external threads in an upper portion and terminating at a lower portion in a rim, the upstanding wall defining an accessible storage space therein and having a floor formed across the wall and positioned above the lower edge of the rim, the base being injection molded and the rim including at least six evenly spaced female thread segments formed on the inner surface of the rim and extending inwardly; and a circular lid for covering said base, said lid defined by an outer vertical wall having internal threads for attaching said lid to said base and a top, said top having an upstanding step sized to engage inside the rim of the base, said step being injection molded and additionally comprising at least six evenly spaced male thread segments formed on an outer surface sized and shaped to mate with the female thread segments formed in the rim of the base, said step and said rim being sized smaller than said outer vertical wall so that said outer vertical wall is visible and accessible when said base is joined over said lid.

13. The container of claim 12, wherein there are twelve female thread segments evenly spaced around the rim and twelve male thread segments evenly spaced around the step.

14. The container of claim 12, wherein the female thread segments around the rim and male thread segments around the step are spirally configured and have a lead angle of approximately 5°.

15. The container of claim 12, further including a second container wherein the first container is adapted to mate with said second container by screwing the base of the first container onto the lid of the second container or by screwing the base of the second container onto the lid of the first container.

16. The container of claim 2, wherein said locking structures comprising said male and female thread segments are configured so that said base and said lid can be rotated with respect to one another no more than 30° during coupling.

17. The container of claim 16, wherein said locking structures are configured so that said base and said lid can be rotated with respect to one another no more than 10° during coupling.

18. The container of claim 6, wherein the first locking structure is formed on the outer surface of the step and comprises a plurality of multiple male thread segments extending outwardly, and said second locking structure comprises a plurality of multiple female thread segments formed on an inner surface of said rim and sized and shaped to mate with the male thread segments formed in the base, the container being adapted to mate with a second container by screwing the base of the first container onto the lid of the second container or by screwing the base of the second container onto the lid of the first container, and wherein said locking structures comprising said male and female thread segments are configured so that said base and said lid can be rotated with respect to one another no more than 30° during coupling.

19. The container of claim 18, wherein said base and said lid can be rotated with respect to one another no more than 10° during coupling.

20. The container system of claim 7, wherein said first and second plurality of multiple thread segments are configured so that said base and said lid can be rotated with respect to one another no more than 30° during coupling.

21. The container system of claim 20, wherein said base and said lid can be rotated with respect to one another no more than 10° during coupling.

22. The container of claim 12, wherein said male and female thread segments are configured so that said base and said lid can be rotated with respect to one another no more than 30° during coupling.

23. The container of claim 22, wherein said base and said lid can be rotated with respect to one another no more than 10° during coupling.

* * * * *